United States Patent [19]

Tanaka et al.

[11] Patent Number: 4,677,407

[45] Date of Patent: Jun. 30, 1987

[54] ELECTROMAGNETIC SWITCH

[75] Inventors: Toshinori Tanaka; Takeo Gotou; Kouhei Ishihara; Yoshiaki Kittaka, all of Himeji, Japan

[73] Assignee: Mitsubishi Denki Kabushiki Kaisha, Tokyo, Japan

[21] Appl. No.: 885,776

[22] Filed: Jul. 15, 1986

[30] Foreign Application Priority Data

Jul. 19, 1985 [JP] Japan ..... 60-111189[U]

[51] Int. Cl.[4] ..... H01H 9/02; H01H 13/04

[52] U.S. Cl. ..... 335/202; 335/278

[58] Field of Search ..... 335/202, 278, 260

[56] References Cited

U.S. PATENT DOCUMENTS 3,223,863 12/1965 Preece et al. .
4,382,241 5/1983 Hehl ..... 335/260
4,515,345 5/1985 Inden ..... 335/260
4,558,293 12/1985 Haneda ..... 335/260

FOREIGN PATENT DOCUMENTS 0058374 9/1985 European Pat. Off. .
53-34282 9/1918 Japan .

*Primary Examiner*—E. A. Goldberg
*Assistant Examiner*—Lincoln D. Donovan
*Attorney, Agent, or Firm*—Leydig, Voit & Mayer

[57] ABSTRACT

An electromagnetic switch for a starter motor is disclosed in which powder produced by friction from repeated opening and closing of the stationary and movable contacts is prevented from entering in between the sliding parts of the movable iron core assembly, thus ensuring the smooth sliding motion of the movable iron core assembly at all times, and in which the penetration of external water into the space defined by the stationary and movable iron cores and the shaft member is effectively prevented thereby to avoid various troubles resulting therefrom.

8 Claims, 4 Drawing Figures

ELECTROMAGNETIC SWITCH

BACKGROUND OF THE INVENTION

1. Field of the Invention

The present invention relates to an electromagnetic switch particularly adapted to be mounted on a starter motor.

2. Description of the Prior Art

FIG. 3 is a side elevational view in cross section showing a starter motor equipped with a conventional electromagnetic switch, and FIG. 4 is a side elevational view of the conventional electromagnetic switch illustrated in FIG. 3, showing the upper half thereof in cross section. In these figures, reference numeral 1 designates a front bracket connected with a casing C in which a starter motor M is accommodated.

Mounted on the front bracket 1 is a conventional electromagnetic switch 2 having a movable iron core assembly 4 constituting a movable magnetic pole. The movable magnetic core assembly 4 has a hook 5 operably connected with a shift lever 3 which is pivotally supported by a projected seat 1*a* on the inner surface of the front bracket 1 and a spacer 7 which is mounted through a grommet 6 on the casing C, the spacer 7 being urged toward the projected seat 1*a* under the resilient action of the grommet 6. Mounted on the front bracket 1 is a cylindrical housing 8 which is formed at its one end with a radially opened recess or socket 8*a* into which a stationary iron core 9 constituting a stationary magnetic pole is fitted and fixed thereto as by caulking together with a cap 11 of a switch cap assembly, generally designated by reference numeral 10. A packing 28 is interposed between an end surface of the cap 11 and the adjacent side surface of the stationary iron core 9. Housed in the cylindrical housing 8 is an electromagnetic coil 12 which is composed of an attraction coil (called P coil) and a support coil (called H coil) and which is wound around a bobbin 13 moulded of a resinuous material. A bushing 14 is mounted on the inner surface of the bobbin 13 and has one end thereof fitted on the radially outer periphery of the annular extension 9*a* axially extending from and integrally formed with the stationary iron core 9, and the other end thereof fitted in an opening 15 formed in the housing 8 at its front end adjacent the front bracket 1.

Slidably fitted in the bushing 14 is a cylindrical-shaped movable iron core 16 having a cylindrical bore 17 into which the hook member 5 is fitted to be axially slidable with a coiled compression spring 18 being disposed under compression between a retainer ring 19 fixedly secured to an end of the movable iron core 16 and a flanged end 5*a* of the hook member 5 for resiliently urging the hook member 5 against the bottom or inner end of the bore 17. The movable iron core 16 is integrally formed at its rear end (the lefthand end in FIG. 3) with a cylindrical shaft member 20 on which is mounted an annular movable contact 22 through the intermediary of an insulating sleeve 21 of an electrically insulating material, the sleeve 21 being slidably fitted over the shaft member 20 so that the movable contact 22 is electrically insulated from the shaft member 20 by means of the insulating sleeve 21 and is slidable together with the insulating sleeve 21 along the outer periphery of the shaft member 20.

The movable contact 22 is urged by a biasing spring 23 toward an annular stationary contact 26 fixedly mounted on the cap 11 in face-to-face relation to the movable contact 22, the biasing spring 23 being formed of a coiled compression spring and disposed between a stepped shoulder on the shaft member 20 and the adjacent end of insulating sleeve 21. The movable contact 22 is also electrically insulated, in addition to the insulating sleeve 21, from the shaft member 20 by means of an insulating washer 24 which is fitted on the shaft member 20 and fixed thereto by means of a stop ring 29.

Disposed between the stationary iron core 9 and the movable iron core 16 is a return spring 25 in the form of a coiled compression spring for biasing the movable iron core 26 in the direction away from the stationary iron core 9 so that the movable contact 22 mounted on the shaft member 20 connected with the movable iron core 16 is biased by means of the return spring 25 in the direction away from a stationary contact 26 firmly secured to the cap 11. The stop ring 29 mounted on one end of the shaft member 20 serves to prevent the insulating sleeve 21, the movable contact 22 and the insulating washer 24 from falling out from the shaft member 20.

In operation, when the electromagnetic coil 12 including the P coil and the H coil is energized, upon closing of a key switch (not shown), by an external power source (not shown), a magnetic flux is produced which passes through a magnetic circuit constituted by the housing 8, the movable iron core 16, the clearance between the movable and stationary iron cores 16 and 9, and the stationary iron core 9, and the movable iron core 16 is magnetically drawn toward the stationary iron core 9. As a result, the return spring 25 is compressed so that the movable contact 22 is caused thereby to move toward and contact with the stationary iron core 9 to energize the starter motor M. On the other hand, when the movable contact 22 contacts the stationary contact 26, the biasing spring 23 is similarly compressed so as to provide the movable contact 22 with an appropriate contact pressure against the stationary contact 26.

Simultaneous with the drawing of the movable iron core assembly 4 toward the stationary contact 26, the P coil of the electromagnetic coil 12 is deenergized and instead the other H coil of the electromagnetic coil 12 acts to hold the entire electromagnetic coil 12 in an energized state.

Also, in accordance with the movement of the movable iron core assembly 4 toward the stationary iron core 9, one end (the upper end in FIGS. 3 and 4) of the shift lever 3, being engaged with the hook 5 connected with the movable iron core assembly 4 by means of the spring 18, is pulled to pivot around a fulcrum or pivot point at which the shift lever 3 abuts against the spacer 7. Therefore, a pinion gear 30, axially slidably fitted over the rotary shaft 31 of the starter motor M for rotation therewith, is forced by the other end (the lower end in FIG. 3) of the shift lever 3 to displace axially on the rotary shaft 31 of the starter motor M, whereby the pinion gear 30 is brought into engagement with a ring gear 32 operably connected with an engine (not shown) with the result that the engine is turned over to be started. Upon starting of the engine, the key switch (not shown) is opened to deenergize the electromagnetic coil 12 so that the magnetic attraction force acting between the stationary iron core 9 and the movable iron core 16 collapses to permit the movable iron core assembly 4 to return to the initial position as illustrated in FIG. 4 under the action of the return spring 25.

With the conventional electromagnetic switch as constructed in the above-described manner, however, the clearance c between the radially inner peripheral surface 21*a* of the shaft member 20 is opened up upon closing of the stationary and movable contacts 26 and 22 so that powder, produced by the friction of repeated opening and closing of these contacts 26 and 22, is liable to come through the clearance c into the sliding surfaces between the bushing 14 and the movable iron core 16, as a consequence of which the sliding motion of the movable iron core 16 relative to the bushing 14 is impaired and further outside water tends to penetrate through the clearance c into a space or chamber S defined by the stationary and movable iron cores 9 and 16, the bushing 14 and the shaft member 20.

SUMMARY OF THE INVENTION

The present invention is intended to obviate the above-mentioned problems of the prior art, and has for its object the provision of an electromagnetic switch for a starter motor in which powder produced by the friction of repeated opening and closing of the stationary and movable contacts is securely prevented from coming between the sliding portions of the movable iron core assembly, thus ensuring smooth sliding motion of the movable iron core assembly at all times, and in which the penetration of external water into the space defined by the stationary and movable iron cores and the movable shaft member is effectively prevented, thus avoiding various troubles resulting therefrom.

In order to achieve the above object, according to one aspect of the present invention, there is provided an electromagnetic switch comprising: a housing made of a magnetic material and including an annular stationary iron core; a hollow cylindrical electromagnetic coil disposed within the housing; a movable iron core disposed in the electromagnetic coil and slidable between a contact open and a contact closed position; the housing defining, in cooperation with the movable iron core, a magnetic circuit through which a magnetic flux generated by said electromagnetic coil can pass for electromagnetically driving the movable iron core between the contact open and closed positions; a stationary contact mounted to the housing; a sleeve mounted on the movable iron core and extending through the annular stationary iron core with a substantially constant clearance therebetween irrespective of the position of the sleeve relative to the stationary core; the clearance being sufficiently small for substantially sealing a space defined between the movable and stationary iron cores against the entrance of foreign matter; and a movable contact mounted on the sleeve for contacting with said stationary contact when the movable iron core is in the contact closed position.

According to another aspect of the present invention, there is provided an electromagnetic switch for a starter motor which comprises: a cylindrical housing being open at its one end and closed at its other end; a cap attached to the open end of the housing; a stationary contact firmly attached to the inner surface of the cap; an electromagnetic coil housed in the housing; a bushing firmly fitted in the electromagnetic coil; an annular stationary iron core disposed in and fixed to the housing; a movable iron core assembly disposed inside the electromagnetic coil and including a movable iron core, the movable iron core being axially slidably fitted in the bushing in a face-to-face relation with the stationary iron core for movement toward and away from the stationary iron core, the stationary and movable iron core and the housing being adapted to form a magnetic circuit upon energization of the electromagnetic coil, the shaft member being disposed inside the annular stationary iron core for movement in the axial direction; an insulating sleeve slidably fitted over the shaft member; a movable contact mounted on one end of the insulating sleeve and electrically insulated from the movable shaft by the insulating sleeve, the movable contact being adapted to contact the stationary contact in accordance with an axial movement of the shaft member caused by energization of the electromagnetic coil; and means for maintaining a limited constant clearance between the insulating sleeve and the stationary iron core at all times irrespective of the axial position of the insulating sleeve relative to the stationary iron core for substantially sealing a space defined by the stationary and movable iron cores.

The means for maintaining a limited constant clearance between the insulating sleeve and the stationary iron core comprises the cylindrical outer peripheral surface of the insulating sleeve having a diameter slightly smaller than the inside diameter of the radially innermost surface of the stationary iron core.

It is preferred that the outer peripheral surface of the insulating sleeve has an axial length longer than the axial distance between the stationary contact and the stationary iron core.

In one embodiment, the entire insulating sleeve is formed of an electrically insulating material.

In other embodiment, that part of the insulating sleeve on which the movable contact is mounted is formed of an electrically insulating material, the remaining part of the insulating sleeve being formed of a bearing material.

Preferably, the bearing material comprises oil-containing sintered metal having self-lubricating properties.

The clearance between the insulating sleeve and the stationary iron core is equal to or smaller than 0.5 mm.

The above and other objects, features and advantages of the present invention will become apparent from the following detailed description of a presently preferred embodiment of the invention when taken in conjunction with the accompanying drawings.

DESCRIPTION OF THE PREFERRED EMBODIMENT

Figure 1:
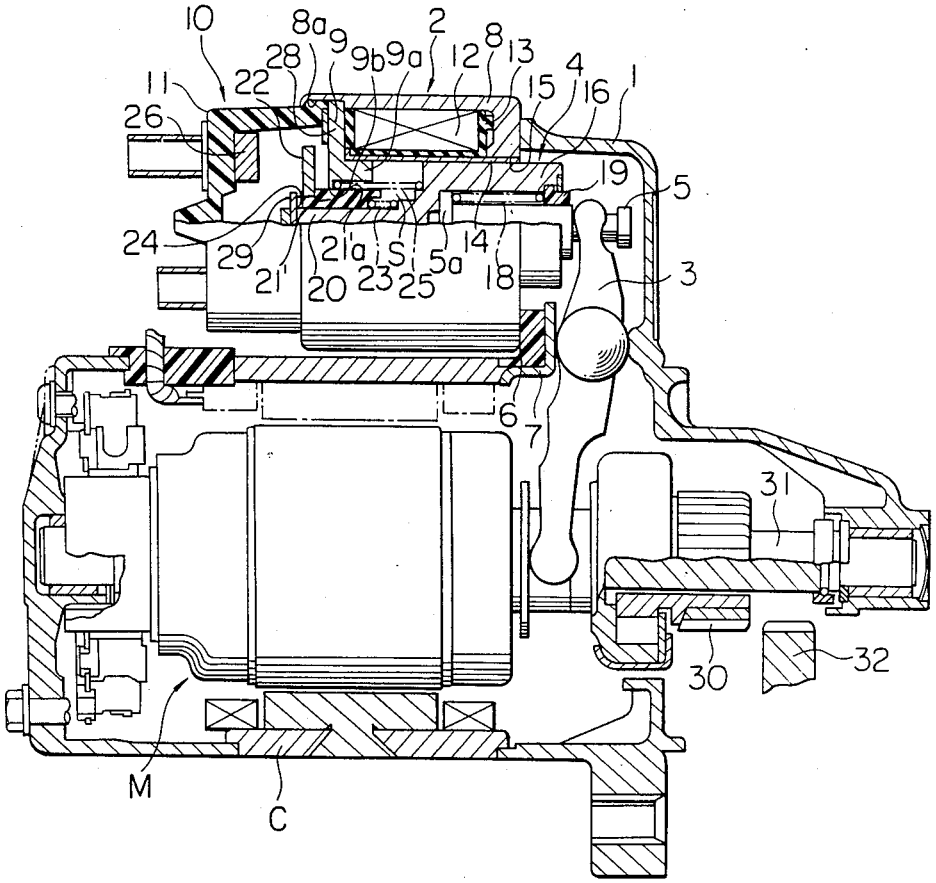
FIG. 1 is a partially cutaway side elevational view showing an engine starter motor equipped with an electromagnetic switch constructed in accordance with the present invention.
Figure 2:
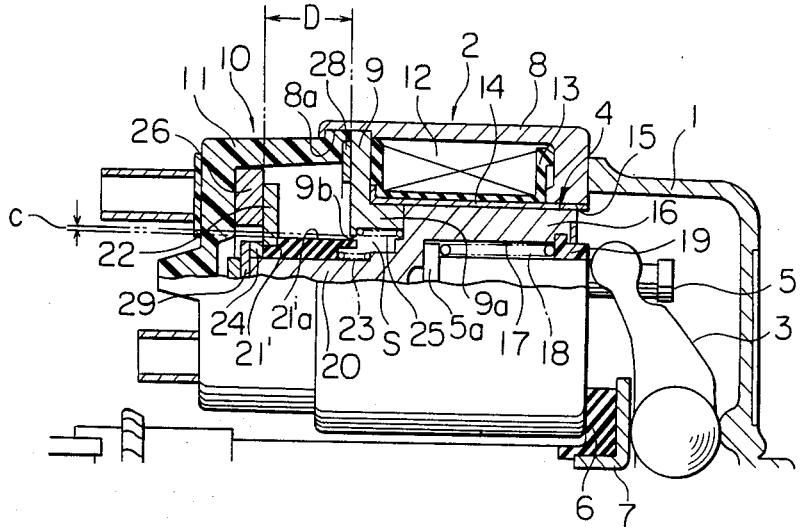
FIG. 2 is a side elevational view of the electromagnetic switch illustrated in FIG. 1, showing the upper half thereof in cross section.
Figure 4:
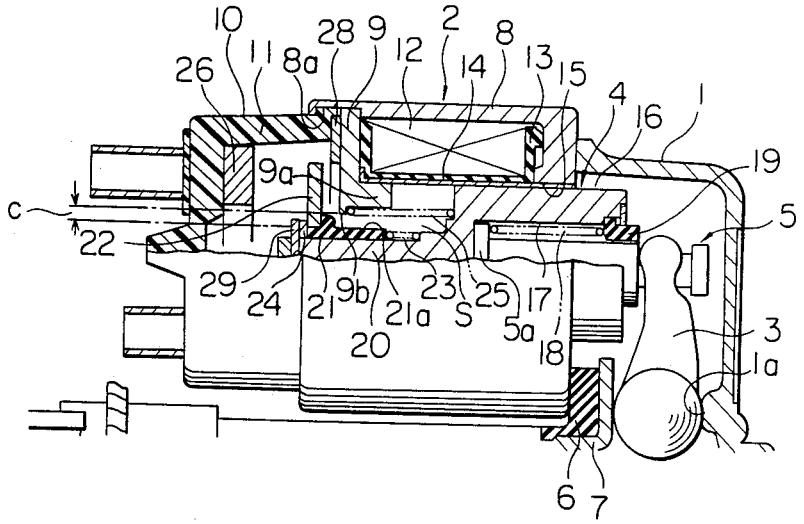
FIG. 4 PRIOR ART
FIG. 4 is a side elevational view of the electromagnetic switch illustrated in FIG. 3, showing the upper half thereof in cross section.
Figure 3:
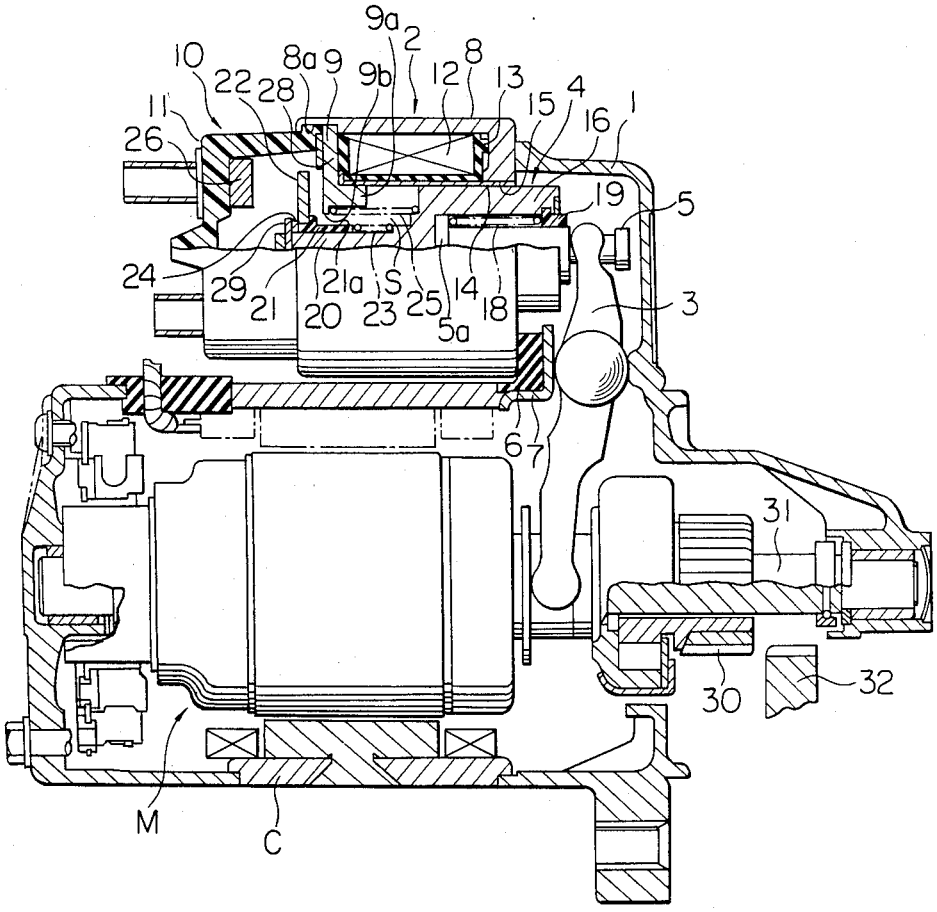
FIG. 3 PRIOR ART
FIG. 3 is a partially cutaway side elevational view showing an engine starter motor equipped with a conventional electromagnetic switch.

Now, the present invention will be described in detail with reference to a presently preferred embodiment thereof as illustrated in FIGS. 1 and 2. In these Figures, reference numerals 1 to 32 excluding 21' designate the same component members as those of the conventional starter motor with the electromagnetic switch as illustrated in FIGS. 3 and 4.

According to the present invention, an insulating sleeve 21' slidably fitted over the shaft member 20 has a cylindrical outer peripheral surface 21'a which has a constant diameter along the axial length thereof and which has an axial length greater than the axial distance D between the stationary contact 26 and the stationary iron core 9. In this case, the outside diameter of the insulating sleeve 21' is determined such that it is slightly smaller than the inside diameter of the radially innermost surface 9b of the stationary iron core 9 so that there is always a very limited clearance c between the outer peripheral surface 21'a of the insulating sleeve 21' and the radially innermost peripheral surface 9b of the stationary iron core 9 irrespective of the axial position of the insulating sleeve 21' relative to the stationary iron core 9.

In this connection, it should be noted that according to the experiments conducted by the inventors, it has been found that when the clearance c between the outer peripheral surface 21'a of the insulating sleeve 21' and the radially innermost peripheral surface 9b of the stationary iron core 9 is 1.8 mm, powder, produced by the friction of repeated opening and closing of the stationary and movable contacts 26 and 22, finds its way into the space S defined by the stationary and movable iron cores 9 and 16, the bushing 14 and the shaft member 20 whereby smooth sliding of the movable iron core 16 relative to the bushing 14 is substantially impaired. On the other hand, when the clearance c is 0.5 mm, there is no entry of powder into the space S, thus causing none of the problems such as sliding troubles.

Although in the above-described embodiment, the entire insulating sleeve 21' is formed of an electrically insulating material, at least that part of the insulating sleeve 21' which contacts the movable contact 22 has to be formed of an electrically insulating material but the remaining part of the insulating sleeve 21' may be formed of an electrically conductive material. Thus, if the sleeve 21' is formed of a bearing material such as an oil-containing sintered metal having self-lubricating properties, the clearance c can be further reduced. In this case, the outer peripheral surface 21'a of the insulating sleeve 21' may be in sliding contact with the inner peripheral surface 9b of the stationary iron core 9.

What is claimed is:

1. An electromagnetic switch comprising:

a housing made of a magnetic material and including an annular stationary iron core;

a hollow cylindrical electromagnetic coil disposed within said housing;

a movable iron core disposed in said electromagnetic coil and slidable between a contact open and a contact closed position;

said housing defining, in cooperation with said movable iron core, a magnetic circuit through which a magnetic flux generated by said electromagnetic coil can pass for electromagnetically driving said movable iron core between said contact open and closed positions;

a stationary contact mounted to said housing;

a sleeve mounted on said movable iron core and extending through said annular stationary iron core with a substantially constant clearance therebetween irrespective of the position of said sleeve relative to said stationary core, said clearance being sufficiently small for substantially sealing a space defined between said movable and stationary iron cores against the entrance of foreign matter; and a movable contact mounted on said sleeve for contacting with said stationary contact when said movable iron core is in said contact closed position.

2. An electromagnetic switch for a starter motor comprising:

a cylindrical housing being open at its one end and closed at its other end;

a cap attached to the open end of said housing;

a stationary contact firmly attached to the inner surface of said cap;

an electromagnetic coil housed in said housing;

a bushing firmly fitted in said electromagnetic coil;

an annular stationary iron core disposed in and fixed to said housing;

a movable iron core assembly disposed inside said electromagnetic coil and including a movable iron core and a shaft member connected with said movable iron core, said movable iron core being axially slidably fitted in said bushing in a face-to-face relation with said stationary iron core for movement toward and away from said stationary iron core, said stationary and movable iron core and said housing being adapted to form a magnetic circuit upon energization of said electromagnetic coil, said shaft member being disposed inside said annular stationary iron core for movement in the axial direction;

an insulating sleeve slidably fitted over said shaft member;

a movable contact mounted on one end of said insulating sleeve and electrically insulated from said shaft member by said insulating sleeve, said movable contact being adapted to contact said stationary contact in accordance with an axial movement of said shaft member caused by energization of said electromagnetic coil; and means for maintaining a limited constant clearance between said insulating sleeve and said stationary iron core at all times irrespective of the axial position of said insulating sleeve relative to said stationary iron core for substantially sealing a space defined by said stationary and movable iron cores against the penetration of foreign matter.

3. An electromagnetic switch for a starter motor as claimed in claim 2 wherein said means for maintaining a limit constant clearance between said insulating sleeve and said stationary iron core comprises the cylindrical outer peripheral surface of said insulating sleeve having a diameter slightly smaller than the inside diameter of the radially innermost surface of said stationary iron core.

4. An electromagnetic switch for a starter motor as claimed in claim 3 wherein the outer peripheral surface of said insulating sleeve has an axial length larger than the axial distance between said stationary contact and said stationary iron core.

5. An electromagnetic switch for a starter motor as claimed in claim 3 wherein said entire insulating sleeve is formed of an electrically insulating material.

6. An electromagnetic switch for a starter motor as claimed in claim 3 wherein that part of said insulating sleeve on which said movable contact is mounted is formed of an electrically insulating material, the remaining part of said insulating sleeve being formed of a bearing material.

7. An electromagnetic switch for a starter motor as claimed in claim 6, wherein said bearing material comprises oil-containing sintered metal having self-lubricating properties.

8. An electromagnetic switch for a starter motor as claimed in claim 2 wherein the clerance between said insulating sleeve and said stationary iron core is equal to or smaller than 0.5 mm.

* * * * *